US011793232B1

(12) United States Patent
Almonte

(10) Patent No.: US 11,793,232 B1
(45) Date of Patent: Oct. 24, 2023

(54) METHOD AND APPARATUS FOR SUPPORTING BREAKABLE CAPSULE IN A CONICAL SMOKING APPARATUS

(71) Applicant: IP TRADEMARK HOLDINGS INC, Mandeville, LA (US)

(72) Inventor: Pedro Almonte, Santiago (DO)

(73) Assignee: IP TRADEMARK HOLDINGS INC., Mandeville, LA (US)

( * ) Notice: Subject to any disclaimer, the term of this patent is extended or adjusted under 35 U.S.C. 154(b) by 0 days.

(21) Appl. No.: 17/993,273

(22) Filed: Nov. 23, 2022

(51) Int. Cl.

| | |
|---|---|
| ***A24D 3/06*** | (2006.01) |
| ***A24D 1/00*** | (2020.01) |
| ***A24D 1/02*** | (2006.01) |
| ***A24C 5/47*** | (2006.01) |
| ***A24D 3/04*** | (2006.01) |
| ***A24D 3/02*** | (2006.01) |
| ***A24D 1/04*** | (2006.01) |

(52) U.S. Cl.
CPC ..... *A24D 3/061* (2013.01); *A24C 5/474* (2013.01); *A24D 1/002* (2013.01); *A24D 1/02* (2013.01); *A24D 1/045* (2013.01); *A24D 3/025* (2013.01); *A24D 3/048* (2013.01); *A24D 3/062* (2013.01)

(58) Field of Classification Search
None
See application file for complete search history.

(56) References Cited

U.S. PATENT DOCUMENTS

| | | | |
|---|---|---|---|
| 1,631,048 | A | 5/1927 | Miller |
| 3,640,287 | A | 2/1972 | Pinkham |
| 6,742,525 | B2 | 6/2004 | Sinclair, Jr. |
| 6,854,471 | B1 | 2/2005 | Sinclair, Jr. |
| D526,086 | S | 8/2006 | Mehta |
| 7,377,281 | B2 | 5/2008 | Bachmann |
| 9,072,319 | B2 | 7/2015 | Kesselman |
| 9,179,706 | B2 | 11/2015 | Jespersen et al. |
| 10,212,965 | B2 | 2/2019 | Sinclair, Jr. et al. |
| 10,905,153 | B1 | 2/2021 | Sinclair, Jr. |
| 11,076,632 | B1 | 8/2021 | Ormaza |
| D947,682 | S | 4/2022 | Shade |
| 11,304,441 | B1 | 4/2022 | Sinclair, Jr. |
| 11,311,044 | B2 | 4/2022 | Shoor et al. |
| 11,369,137 | B1 | 6/2022 | Wahidi |
| 11,395,508 | B1 | 7/2022 | Wahidi |
| 11,395,509 | B1 | 7/2022 | Wahidi |
| 2007/0068543 | A1 | 3/2007 | Chen |
| 2020/0352216 | A1 | 11/2020 | Shade |

*Primary Examiner* — Phu H Nguyen
(74) *Attorney, Agent, or Firm* — Roy Kiesel Ford Doody & North, APLC; Brett A. North

(57) ABSTRACT

A smoking product and method of making thereof for the consumption of a smokable substance. The product has a hollow conical shape that allows for the easy insertion of smokable substances. Additionally, the conical or frusto-conical shape of the product provides for larger amounts of smokable substances in the end of the product the consumer lights, resulting in an initial slower prolonged burn. Additionally, the product includes a supporting filter tip with a frangible capsule contained therein and is packaged for sale in packaging in an unfilled state allowing a user to remove the product from the packaging, fill it with the user's selected custom smokable filler and form a custom smoking product.

15 Claims, 12 Drawing Sheets

METHOD AND APPARATUS FOR SUPPORTING BREAKABLE CAPSULE IN A CONICAL SMOKING APPARATUS

CROSS-REFERENCE TO RELATED APPLICATIONS

Not Applicable.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

The present invention relates to smoking articles such as preformed smoking shells. More particularly, the present invention relates to an improved preformed conical smoking shell, packaged for sale in an unfilled state, having an interior supporting a frangible capsule wherein the capsule is supported in the smoking shell by a combination of biasing and frictional forces.

Many smokers prefer to use their own smokable filler product as opposed to purchasing cigars that are already constructed and filled with a manufacturer's selection of smokable filler. These users of fine, custom smokable filler prefer to start with an empty preformed conical smoking shell, which they prefer to purchase, and then fill it with their own custom smokable filler after the conical smoking shell has been removed from its package.

BRIEF SUMMARY OF THE INVENTION

Various embodiments relate generally to products for the consumption smokable substances, and more particularly to a product and method of making thereof for the consumption of smokable substances having a hollow conical or frustoconical shape. A conically or frustoconically shaped smoking shell has an outer surface, a large diameter end, a small diameter end, and a cavity that extends to said small diameter end.

Various embodiments related generally to products and methods of making thereof, for consumption of smokable filler such as herbs and other smokable substances.

In various embodiments is provided a product that is easy to use and provides for a superior smoke.

Various embodiments provide for a method of making a conical smoking shell for the consumption of smokable substances resulting in a product that is easy to construct, fill, and finish, and provides for a consistent quality smoke.

In various embodiments the present invention may comprise a container for packaging the hollow conical smoking shell with frangible additive capsule. In various embodiments the packaging can be a pouch, a bag, a flexible wrapper, or a tube.

Additionally, in various embodiments is provided an elongated member for packing smokable substances into the hollow conical smoking shell can be provided when packaged for sale.

One embodiment provides for a method of making a custom conical smoking shell for the consumption of smokable fillers with frangible capsules, wherein the number of steps required for the consumer to produce a final customized smokable product is reduced as compared to prior art methods.

In one embodiment is provided a product for smoking smokable filler, herbs, and other smokable substances, comprising:

- a hollow cone having a hollow cone longitudinal axis,
- a first end defining a larger cone opening perimeter, and
- a second end defining a smaller first cone opening perimeter,
  - whereby the larger cone opening perimeter has a diameter greater than the diameter of the smaller cone opening perimeter,
  - whereby a line spanning between the larger and smaller cone opening perimeters has a slope and length; and
- a cone interior being defined by a space between the larger cone opening perimeter and the smaller cone opening perimeter.

In one embodiment is provided a packaged conical smoking apparatus that generates a smokable article, comprising:

a) a package having an interior and an end portion with a sealed opening;
b) a conical smoking shell being hollow and conically shaped with a shell interior;
c) a reinforcing tip that occupies a position within the shell interior, the reinforcing tip having a stiffness that is greater than the stiffness of the conical smoking shell;
d) wherein the reinforcing tip has a plurality of transversely oriented panels forming a plurality of pathways through the reinforcing tip and a frangible capsule oriented between a selected two of the plurality of transversely oriented panels wherein the frangible capsule is held in place by a wedging force created by wedging apart the two selected transversely oriented panels caused by insertion of the frangible capsule between the selected two transversely oriented panels;
e) wherein the conical smoking shell, reinforcing tip, and frangible capsule are packaged inside the package interior as an assembly.

In one embodiment the reinforcing tip further includes a frustoconical perimeter and the frictional force created by wedging apart the two selected transversely oriented panels caused by insertion of the frangible capsule between the selected two transversely oriented panels and the frustoconical perimeter.

In one embodiment is provided a conical smoking shell that generates a smokable article, comprising:

a) a package having an interior and an end portion with a sealed opening;
b) a hollow conically shaped smokable shell with a shell interior;
c) a reinforcing tip that occupies a position within the shell interior, the reinforcing tip having a stiffness that is greater than the stiffness of the conical smoking shell;
d) wherein the reinforcing tip has a plurality of transversely oriented panels forming a plurality of pathways through the reinforcing tip and a frangible capsule positioned between a selected two of the plurality of transversely oriented panels wherein the frangible capsule is held in place by a frictional force created by wedging apart the two selected transversely oriented panels caused by insertion of the frangible capsule between the selected two transversely oriented panels;
e) wherein the conical smoking shell, reinforcing tip, and frangible capsule are packaged inside the package interior as an assembly.

In one embodiment the reinforcing tip further includes a frustoconical perimeter and the frictional force created by wedging apart the two selected transversely oriented panels caused by insertion of the frangible capsule between the selected two transversely oriented panels and the frustoconical perimeter.

In one embodiment is provided a method of constructing a smoking product, comprising the steps of:

a) providing a package having an interior and an end portion with a sealed opening;
b) providing a hollow, conically shaped smokable shell with a shell interior;
c) placing a reinforcing tip within the shell interior of the conically shaped smokable shell;
d) wherein the reinforcing tip has a plurality of transversely oriented panels forming a plurality of pathways through the reinforcing tip and a frangible capsule positioned between a selected two of the plurality of transversely oriented panels wherein the frangible capsule is held in place by a frictional force created by wedging apart the two selected transversely oriented panels caused by insertion of the frangible capsule between the selected two transversely oriented panels;
e) placing a push rod in the package;
f) wherein the conical smoking shell, reinforcing tip, frangible capsule, and push rod are packaged inside the package interior as an assembly;
g) enabling the construction of finished smoking product by removal of the smokable shell from the package so that a user can fill the smokable shell a selected smokable material, using the push rod to compact smokable material that is placed within the smokable shell; and
h) wherein the reinforcing tip is configured to support frangible capsule during step "g".

In one embodiment the push rod is cone shaped.

In one embodiment, the push rod nests inside the smokable shell.

In various embodiments the conical smokable shell and/or smokable sheet can be comprised of smokable materials chosen from any combination of the following materials: natural leaf, homogenized tobacco paper, pipe tobacco, different types of flavored tobacco, cellulose (clear, opaque, or colored), bleached or non-bleached paper, cigarette paper, rice paper, herbal materials, tea leaves, kanna, blue lotus, salvia, salvia eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, *Capillarius herba*, Yerba Lenna Yesca, Calea Zacatechichi, *Leonurus* Sibericus Flowers, Wild Dagga Flowers, Klip Dagga Leaf, Damiana, Hookah, hemp, *Hemia salicifolia*, Kava Kava, *Avena Sativa*, scotch broom topps, Valarian, *capillarius, herba*, Wild clip dagga, *Leonurus sibiricus*, Kanna, Sinicuichi, chocolate, herbal components, and/or *Lactuca virosa*.

In various embodiments the smokable filler material can be selected from any combination of the following types of filler material: smoking tobacco, pipe tobacco, different types of flavored tobacco, herbal materials, tea leaves, kanna, blue lotus, *salvia, salvia* eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, *Capillarius herba*, Yerba Lenna Yesca, Calea Zacatechichi, *Leonurus* Sibericus Flowers, Wild Dagga Flowers, Klip Dagga Leaf, Damiana, Hookah, *Hemia salicifolia*, Kava Kava, *Avena Sativa*, scotch broom topps, Valarian, *capillarius, herba*, Wild clip dagga, *Leonurus sibiricus*, Kanna, Sinicuichi, and/or *Lactuca virosa*.

In various embodiments the conical smoking shell, filter tip, and/or smokable filler can include liquid for moisturizing, and also preferably includes flavoring and/or scenting. The liquid can be, in whole or in part, water, alcohol, solvent, oil, propylene glycol, ethyl alcohol, glycerin, benzyl alcohol as examples. The liquid can be flavored and/or scented with items such as for example apple, apple martini, berries, blueberry, champagne, chocolate, coco/vanilla, cognac, cosmo, gin, grape, honey, lychee, mango, menthol, mint choco, peach, piña colada, punch, purple, rum, strawberry/kiwi, vanilla, watermelon, wet cherry, and/or whiskey. This flavored liquid is typically applied at levels of between about 0.01 to 45% by weight, and preferably between about 0.1% to 10% by weight. This flavored liquid is typically applied to the at least one pre-rolled sheet with a carrier liquid such as ethyl alcohol, propylene glycol, water or the like. Glycerin and invert sugar can also be used as a carrier. Some humectants can also be used, however, little or no humectants can be used. In general terms, the flavors can be provided by botanical extracts, essential oils, or artificial flavor chemicals, any one of which or a combination thereof mixed with a carrying solvent such as propylene glycol, ethyl alcohol, glycerin, benzyl alcohol, or other alcohol, for example. Other flavors can include cocoa, licorice, coffee, vanilla or other botanical extracts. Essentials oils can be used such as wine essence, cognac oil, rose oil, mate or other oils.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

Figure 1:
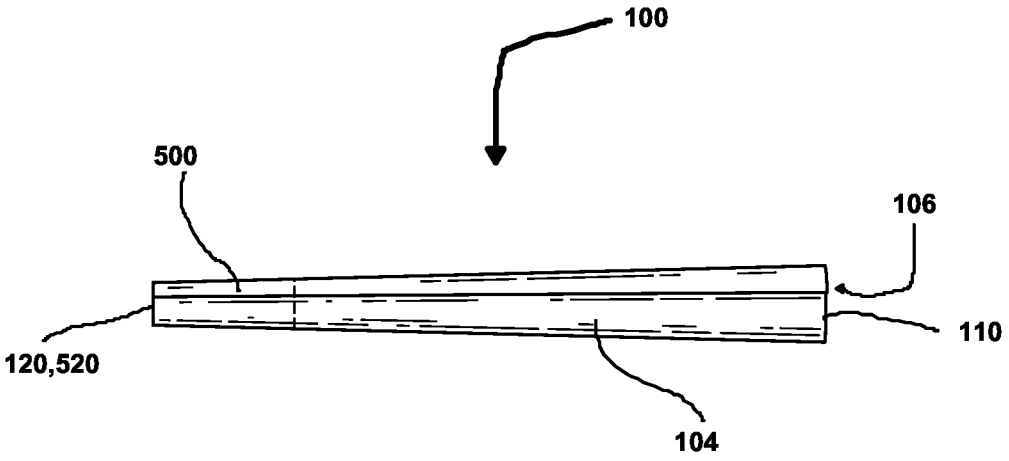
FIG. 1 is a perspective view of a conical smoking shell by itself.

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Smokable article kit can include conical smoking shell 100 packaged for sale in a flexible packaging 800 (such as a foil pouch) when not filled with smokable filler material.

Package or flexible wrapper 800 can be flexible and any shape such as rectangular. The package 800 has interior 830 that can be closed. The interior 830 can be sized and shaped to contain cigar cone 100. The package or wrapper 830 has closed end 810 and open end 820 that would enable insertion of the combination of cone 100 into the interior 830. A seal 840 could be formed at in order to encapsulate cone into the interior 830.

In various embodiments the apparatus of the present invention enables a user or smoker to support his or her custom smokable filler into hollow interior of cone 100 after removing cone 100 from package or wrapper 800. The larger section of 100 has a frustoconical shape with an opening into which custom smokable filler material can be added.

A user 5 can use rod 700 to tamp or compress the smokable material within larger section of cone or shell 100. In such a situation, filter tip 500 of cone 100 prevents the tamped smokable filler material added from exiting the interior 114 of cone or shell 100. The open end 150 of cone or shell 100 can be wrapped, folded, and/or twisted until it is closed to form a closure.

The finished article can be smoked by placing the filter end in the user's mouth and by lighting the closure.

FIG. 1 is a perspective view of conical smoking shell 100 by itself which can be constructed by conventional methods. Conical smoking shell 100 can include first end 110, second end 120, outer surface 140, and filter tip 180. At first end 110 can be first opening 150. At second end 120 can be second opening 160. First opening 150 can be larger than second opening 160 giving first cone 100 its conical shape. Between first end 110 and second end 120 is interior portion 114 which includes inner surface 130.

Frangible Capsule

Figure 2:
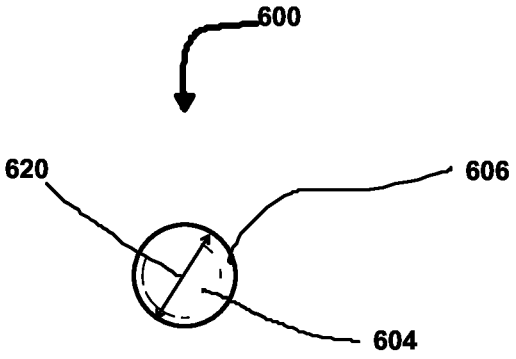
FIG. 2 is a perspective view of a frangible capsule or bead.

FIG. 2 is a perspective view of a frangible capsule or bead 600 which is shown as being spherical. The term frangible capsule is used in its broadest sense to mean any secured substance, regardless of how the substance is secured. For example, the substance may be a liquid, which is secured using a gelatinous shell (i.e., a gel cap).

For example, the frangible capsule (e.g., gel cap) may include a frangible shell which may be fractured or broken open by external forces. The shell can be constructed using a material that will produce a "snap" sound when it breaks. Not only does this create an auditory experience that a user may like (e.g., find enjoyable, etc.), but it allows a user to know when the shell breaks via the audible "snap" and fluid is being dispersed. The capsule may be constructed using a cellulose-based shell, which may be vegan, organic, etc. Such a shell will "snap" when it is crushed.

As another example, the frangible capsule (e.g., gel cap) may include a shell having an opening. Liquid may then be added to the shell via the opening and a cap or plug may be used to close (or plug) the opening. As another example, the shell can be constructed using a material that will produce a "snap" sound when it breaks. Not only does this create an auditory experience that a user may like (e.g., find enjoyable, etc.), but it allows a user to know when the shell breaks via the audible "snap" and fluid is being dispersed. The capsule may be constructed using a cellulose-based shell, which may be vegan, organic, etc. Such a shell will "snap" when it is crushed.

As another example, the secured substance (e.g., liquid additive) may be secured using a two-part capsule comprising a first half and a second half are assembled during a manufacturing process. Depending on how the two halves are constructed and mated together, the weakest part of the capsule, and therefore the first to break upon the application of inward pressure, may be the joint itself, which may cause the liquid therein to be along the break line.

In various embodiments the secured contents in the frangible capsule can be a liquid which includes one or more additives. The additive(s) can be flavoring, flavonoids (or flavonoid oils) (e.g., flavonols, such as those naturally found in apples, tomatoes, etc., flavan-3-ols, such as those found in bananas, blueberries, etc., flavones, such as those found in parsley, oranges, etc., flavonones, such as those found in grapefruit, lemons, etc., and anthocyanidins, such as those found in strawberries, cherries, etc.), liquid nicotine, cannabinoids (or cannabinoid oils) (e.g., tetrahydrocannabinol (THC), cannabidiol (CBD), cannabinol (CBN), cannabigerol (CBG), etc.), and/or terpenoids (or terpenoid oils) (e.g., pinene, myrcene, limonene, caryophyllene, linalool, humulene, ocimene, terpinolene, citrulline, etc.).

In various embodiments the secured contents may also include other substances, such as propylene glycol, glycerin (naturally derived, e.g., vegetable glycerin, etc.) and/or synthetically derived (e.g., from petroleum, etc.)), etc., which may function as a diluent for thicker, lower viscosity substances (e.g., cannabinoid oils, etc.).

In various embodiments the fluid should preferable increase, alter, or supplement the effects of flavor, taste, smell, medicinal value, and/or enjoyability of the smokable product.

Filter Tip

Figure 3:
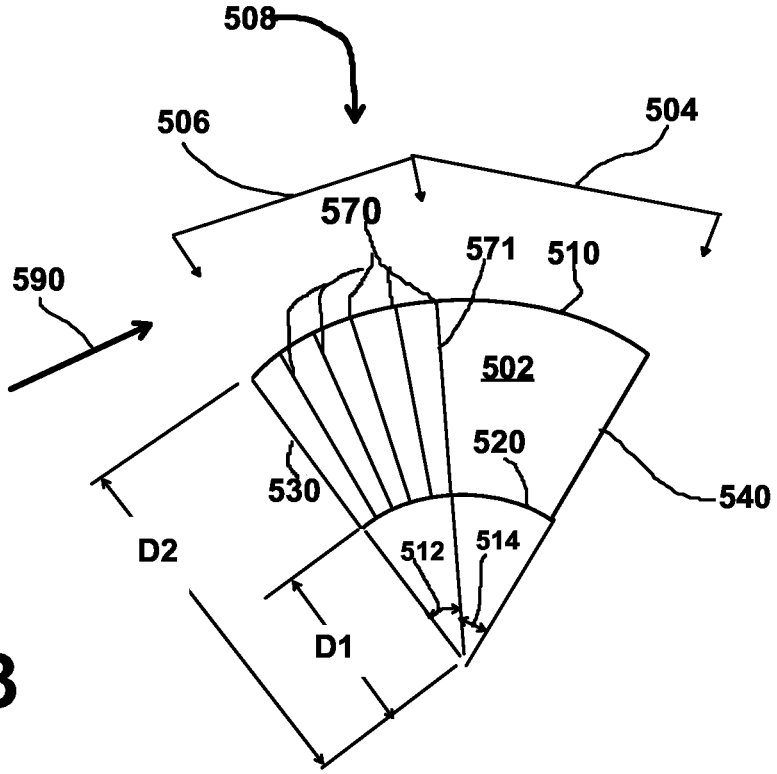
FIG. 3 is a top view of a semicircular filter strip having fold lines.

Filter tip 500 can be formed from a semi-circular sheet of material 508. FIG. 3 is a top view of filter tip 500 shown flat. When flat, sheet of material 508 can include first section 504 (falling within projected angle 512), second section 506 (falling within projected angle 514), first end 510, second end 520, first edge 530, second edge 540, first face 502, and second face 503. Second section 506 can include a plurality of fold lines 570 which can be perforated, weakened, lined, etched or pre-folded. First section 504 can provide external support when rolled around second section 506.

Sheet of material 508 can have a thickness greater than the thickness of sidewall 102 of cone 100. Sheet of material 508 for filter tip 500 can be pliable and deformable material, such as paper, plastic, metal and the like, that is capable of retaining a folded and spiral shape when folded and then rolled upon itself from one end. In a preferred embodiment, the filter tip 500 can be formed from a material is relatively less flammable than cone side wall 102 and/or the smokable filler 1100 so that when all of the smokable filler material has been consumed the smokable article becomes extinguished.

In forming conical filter tip 500, second section 506 (falling within projected angle 512) of sheet 508 can be folded upon itself (such as by using perforation or fold lines 570 to assist in the folding and schematically indicated by arrow 590). Second section 506 can be placed between a users thumbs and forefingers and is folded alternatively (or in an undulating manner) toward first perforation or etched line 571. The number of times that second section 506 of sheet of material 508 can be folded upon itself depends both on angle 512 and the number of fold lines 570 (e.g., the distance between fold lines 570).

Generally, after the folding of second section 506, first section 504 is rolled about "now folded" second section 506 (schematically indicated by arrow 590) until filter tip 500 is formed as schematically shown in FIGS. 4 through 7.

Figure 4:
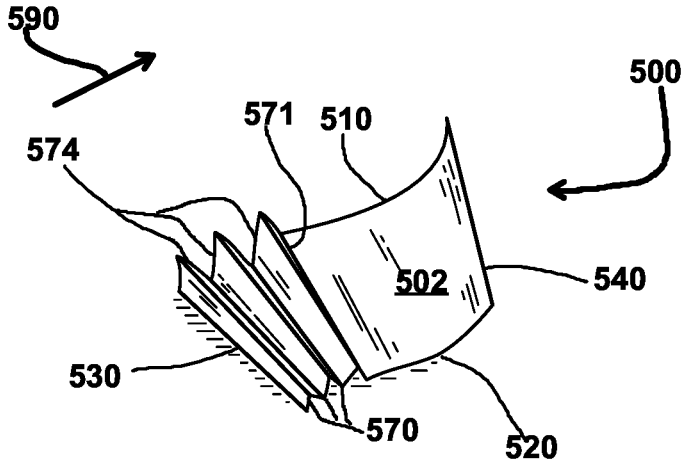
FIG. 4 is a top perspective view of the filter tip shown being fabricated with the folding of a plurality of transversely oriented panels and the outer support beginning to be rolled.

Filter tip 500 can be constructed by both folding a first portion 506 (from first edge 530 to the plurality of fold lines 570) and rolling the second portion 508 of its flat sheet form (from second edge 540) into a hollow cone shape. FIG. 4 is a top perspective view of the filter tip 500 shown being fabricated with the folding of a plurality of transversely oriented panels via fold lines 570 and the support beginning to be rolled.

Figure 5:
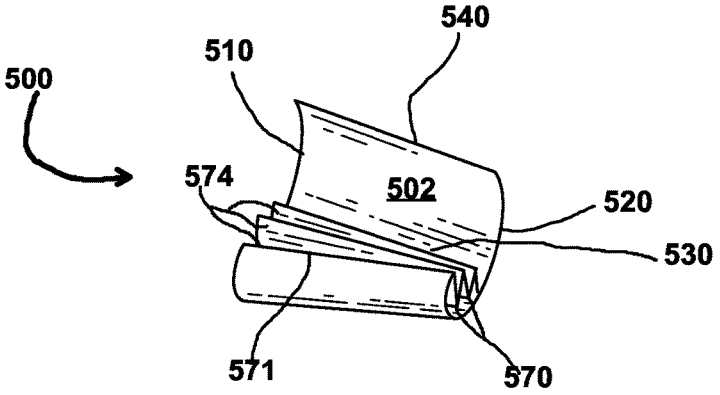
FIG. 5 is a top perspective view of the filter tip of FIG. 4 shown with a plurality of transversely oriented panels and the outer support being rolled to form a frustoconical perimeter.
Figure 6:
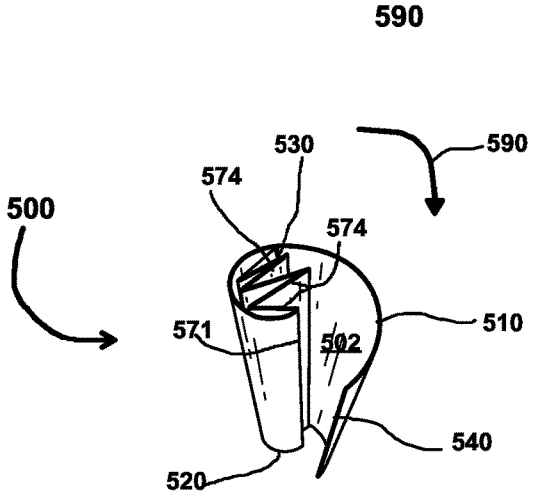
FIG. 6 is a top perspective view of the filter tip of FIG. 4 shown with a plurality of transversely oriented panels and the remainder being rolled to form a frustoconical perimeter.
Figure 7:
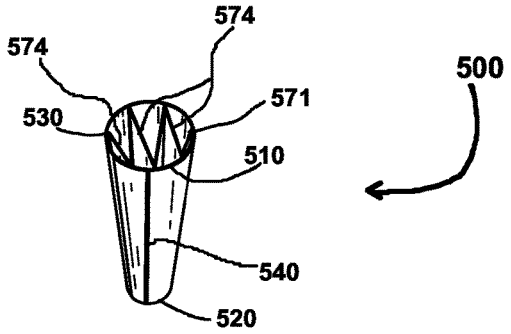
FIG. 7 is a perspective view of the outer support of the filter tip shown fully rolled.

FIG. 5 is a top perspective view of the filter tip of FIG. 4 shown with a plurality of transversely oriented panels 574 and the second portion 508 or outer support being rolled to form a frustoconical perimeter. FIG. 6 is a top perspective view of filter tip 500 shown with a plurality of transversely oriented panels 574 and the remainder of second portion 508 being rolled to form a frustoconical perimeter. FIG. 7 is a perspective view of the second portion 508 or outer support of the filter tip 500 shown fully rolled.

At first end 510 can be first opening 512. At second end 520 can be second opening 522. First opening 512 can be larger than second opening 522 giving inner support 500 its conical shape. Between first end 510 and second end 520 is interior portion 514 which includes the plurality of folds 570, which plurality of folds resist flattening of the conical shape of inner support 500.

Figure 8:
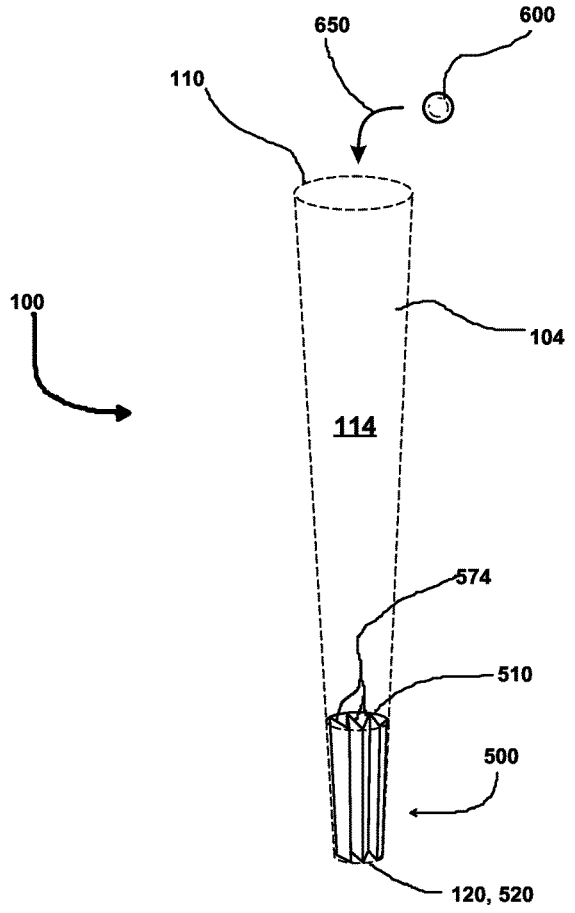
FIG. 8 is a perspective view of the filter tip inside a cone, and schematically indicating the dropping or insertion of a frangible capsule into the interior of the cone.

FIG. 8 is a perspective view of the filter tip 500 shown fully rolled and located in cone 100. Cone 100 can include first end 110, second end 120, sidewall 102, outer surface 140, and filter tip 500. At first end 110 can be first opening 150. At second end 120 can be second opening 160. First opening 150 can be larger than second opening 160 giving cone 200 its conical shape. Between first end 110 and second end 120 is interior portion 114 which includes inner surface 130.

Affixing Frangible Capsule to Filter Tip

FIGS. 8 through 13 schematically illustrate one embodiment of a method of attaching frangible capsule 600 to filter tip 500.

FIG. 8 is a perspective view of filter tip 500 located inside a conical smoking shell 100, and schematically indicating the dropping or insertion of a frangible capsule 600 into the interior 114 of the cone.

Figure 9:
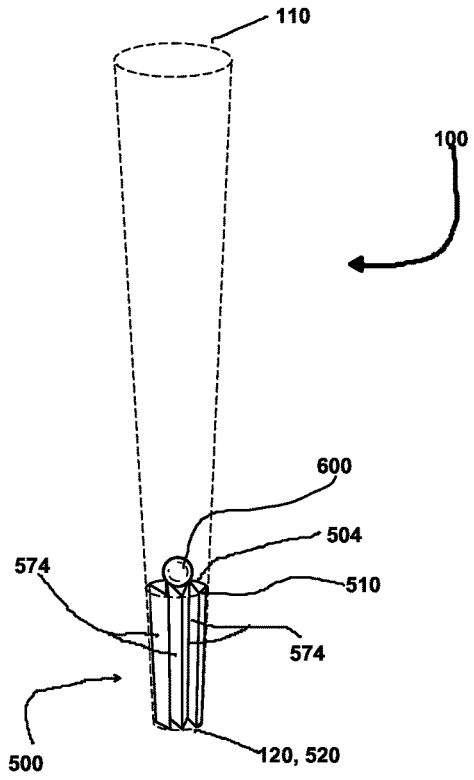
FIG. 9 is a perspective view of the frangible capsule located inside the cone and on the top of the filter tip.

FIG. 9 is a perspective view of the frangible capsule 600 located inside the conical smoking shell 100 and on the top of the filter tip 500 at first end 510 (on top of plurality of transverse panels 574 will support frangible capsule 600). However, plurality of transverse panels are flexible and have a memory that can be used to hold in place frangible capsule 600 by wedging frangible capsule 600 between a selected two of the plurality of transverse panels 574.

Figure 10:
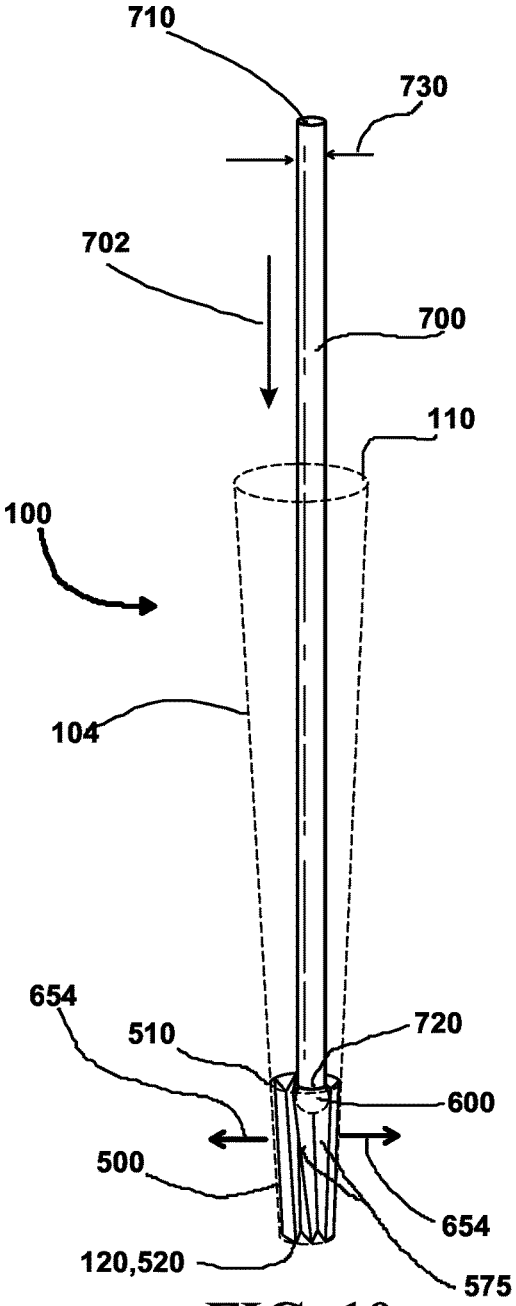
FIG. 10 is a side perspective view schematically showing the wedging of frangible capsule between a selected two of the transversely oriented panels.
Figure 11:
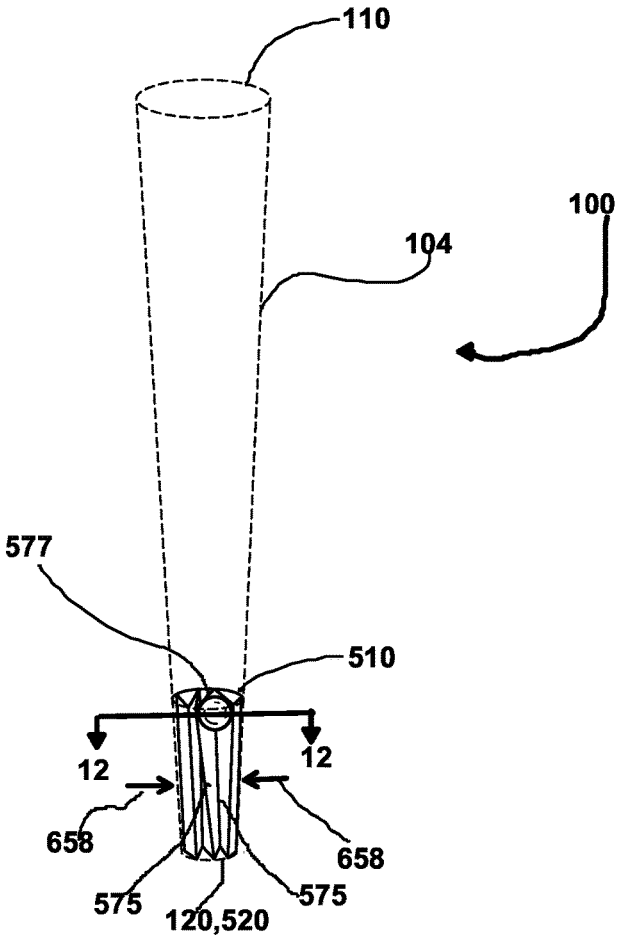
FIG. 11 an enlarged side perspective view of the cone schematically showing the frangible capsule wedged between a selected two of the transversely oriented panels such that the frangible capsule is flush with the top of the selected two of the transversely oriented panels.
Figure 12:
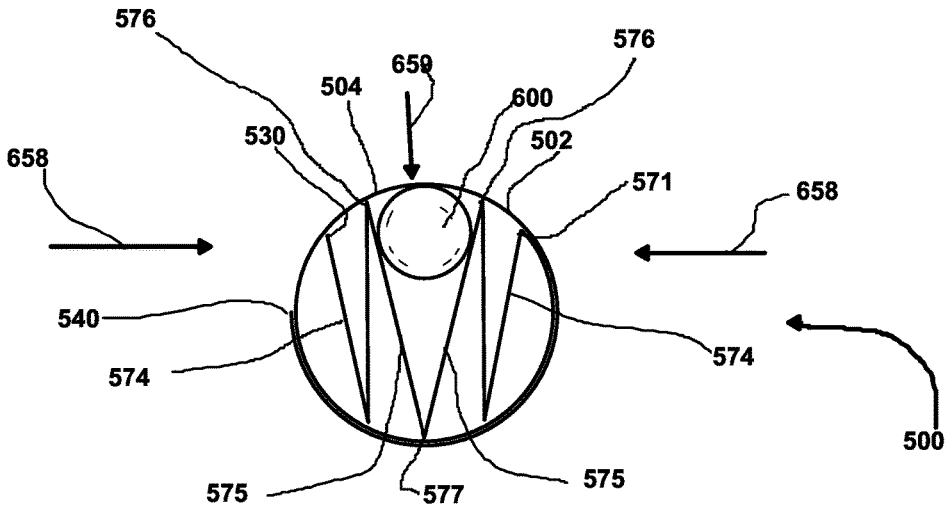
FIG. 12 is a sectional view taken along the lines 12-12 of FIG. 11 showing the frangible capsule wedged between a selected two of the transversely oriented panels and the frustoconical perimeter.

FIG. 10 is a side perspective view schematically showing the wedging of frangible capsule 600 between a selected two of the transversely oriented panels 574. FIG. 11 an enlarged side perspective view of the conical smoking shell 100 schematically showing the frangible capsule 600 wedged between a selected two of the transversely oriented panels 574 such that the frangible capsule 600 is flush with the top 510 of the selected two of the transversely oriented panels 574. FIG. 12 is a sectional view taken along the lines 12-12 of FIG. 11 showing the frangible capsule 600 wedged between a selected two of the transversely oriented panels and the frustoconical perimeter.

Second end 720 of stuffing tool 700 is placed in contact with frangible capsule 600 and forced downwardly (in the direction of arrow 702) to be wedged between a selected two of the transversely oriented panels 574. Arrow 702 schematically indicates a downward force being applied to stuffing tool 700 which downward force is transmitted to frangible capsule 600 causing frangible capsule 600 to push out (schematically indicated by arrows 654) a selected two of the transversely oriented panels 574 thereby increasing the distance between the select two of the transversely oriented panels 574. Because the select two transversely oriented panels 574 have a memory, which after being wedged apart, creates a biasing force where the select two transversely oriented panels attempt to move back to their position before frangible capsule 600 was wedged between the select two transversely oriented panels. This reactive/return biasing force is schematically indicated by arrows 658 in FIG. 11, and will create "a frictional force" holding in place frangible capsule 600. The amount of the frictional force created is a function of the coefficient of friction along with the reactive/return biasing force.

In various embodiments the coefficient of friction can be impacted by modifications to the surface of frangible capsule 600 and/or a select two of the plurality of transversely oriented panels 575.

In various embodiments at least a portion of the surface of filter tip 500 and/or frangible capsule 600 can modified to increase its roughness and coefficient of friction to assist in filter tip 500 in holding frangible capsule 600 when wedged. Roughness meters, also called "surface roughness meters," are instruments that measure the smoothness (degree of roughness) of the surface of a target. The main types of meters use either probes or lasers.

In various embodiments one or both of the surfaces filter tip 500 and/or frangible capsule 600 can be roughened by mechanical sanding with sandpaper. In various embodiments the sand paper used can be selected from the group consisting of 40, 80, 100, 120, and 220 grit. In various embodiments the sandpaper used can fall within a range of any two of the above reference grit sizes.

In various embodiments one and/or both of the surfaces filter tip 500 and/or frangible capsule 600 can be roughened by mechanical means to increase their surface roughness by a minimum percentage. In various embodiments the surface roughness can be mechanically increased by at least 10, 20, 30, 40, 50, 60, 70, 80, 90, 100, 125, 150, 175, 200, and 250 percent. In various embodiments the roughness can be mechanically increased within a range of any two of the above reference percentages.

In various embodiments at least part of the surface of filter tip 500 and/or frangible capsule 600 can include an adhesive (e.g., cigar glue or contact cement) which can assist frangible capsule 600 in being held between the select two of the plurality of transversely oriented panels 575.

Figure 11B:
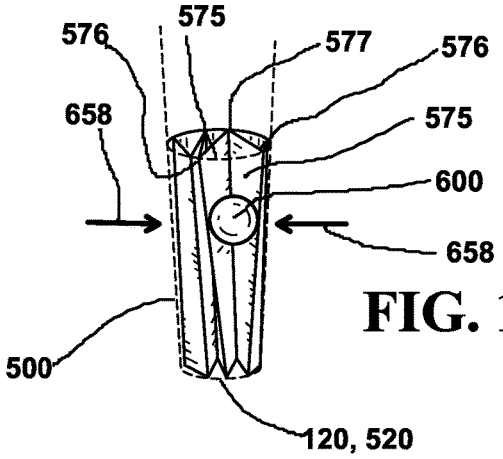
FIG. 11*b* an enlarged side perspective view of the conical smoking shell schematically showing the frangible capsule wedged between a selected two of the transversely oriented panels such that the frangible capsule is between the top and bottom of the transversely oriented panels and about 25 percent from the top.

Because filter tip 500 is frustoconically shaped, the distances between the different plurality of transverse panels 574 decreases from first end 510 to second end 520 of filter tip 500. Generally the amount of reactive biasing force increases as the relative distances between the transversely oriented panels is increased from its original relative distance. Accordingly, it is expected that the amount of reactive biasing force increases as frangible capsule is pushed closer to second end 520 of filter tip 500. This phenomenon may be impaired when plastic (and non-elastic) deformation is seen in filter tip 500 when pushing down frangible capsule 500. FIG. 11*b* an enlarged side perspective view of the cone 100 schematically showing the frangible capsule 600 wedged between a selected two of the transversely oriented panels 574 such that the frangible capsule 600 is between the top 510 and bottom 520 of the transversely oriented panels 574 and about 25 percent from the top 510. In various embodiments frangible capsule 600 can be located about 5, 6, 7, 8, 9, 10, 12, 14, 15, 16, 18, 20, 25, 30, 35, 40, 45, and/or 50 percent from the top 510. In various embodiments frangible capsule 600 can be located within a range of between any two of the above referenced percentages from top 510 of filter tip 500 (relative to the bottom 520).

FIG. 12 is a sectional view taken along the lines 12-12 of FIG. 11 showing the frangible capsule 600 wedged between a selected two of the transversely oriented panels 575 and first section 504 of support section 502 of sheet 508. Frangible capsule 600 is also vertically located flush with upper frustoconical perimeter 511). Because the select two transversely oriented panels 575 have a memory, when being wedged apart, creates reactive biasing forces where the select two transversely oriented panels 575 attempt to move back to their positions before frangible capsule 600 was wedged between the select two transversely oriented panels 575 and first section 504 of filter tip 500. These reactive/return biasing forces are schematically indicated by arrows 658 and 659 in FIG. 12, and will create "a frictional force" holding in place frangible capsule 600 in place between first section 504 and the select two transversely oriented panels 575. The amount of the frictional force created is a function of the coefficient of friction along with the reactive/return biasing forces. As shown in FIG. 12 edges 576 of the select two transversely oriented panels 575 have a small gap between edges 576 and first section 504 of filter tip 500.

Whether or not the edges 576 of the select two transversely oriented panels 575 are in contact (or have a gap) with respect to first section 504 depend on the spacing between edge lines 570 and how tightly filter tip 500 is rolled. If rolled tightly (e.g., smaller upper perimeter 511)

then it is expected that edges 576 will be in contact with section 504 of filter tip 500, but if rolled loosely (e.g., larger upper perimeter 511) then it is expected that a gap would exist. Where edges 575 are in contact then it is expected that wedging frangible capsule 600 between the select two transversely oriented panels 575 will cause not only the panels 575 to bend away from each other about vertex 577, but also bend themselves to tend to bend and conform about the shape of frangible capsule 600. Such "conformance" bending is believed to increase the wedging and holding power of the select two transversely oriented panels 575 (and also first section 504)

Figure 12B:
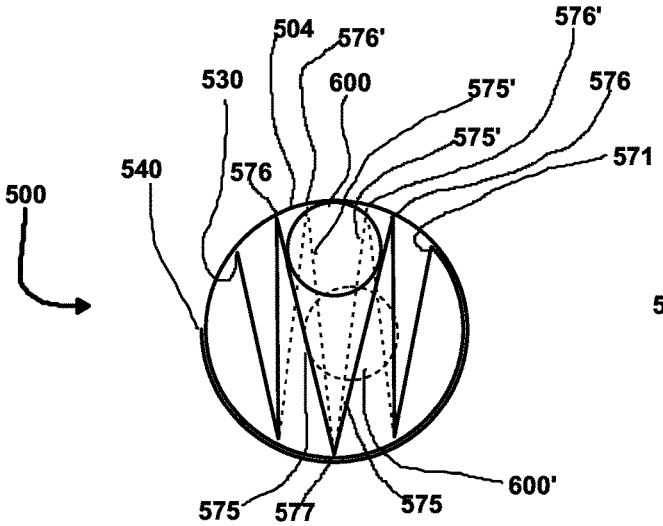
FIG. 12*b* is another view of FIG. 12 schematically showing the positions of both the frangible capsule and the plurality of transversely oriented panels before and after wedging of the frangible capsule.

FIG. 12*b* is another view of FIG. 12 schematically showing the positions of both the frangible capsule 600 and the plurality of transversely oriented panels 575 before and after wedging of the frangible capsule 600. The select two transversely oriented panels 575' are shown in broken lines to indicate positions before wedging of frangible capsule 600'. The select two transversely oriented panels 575 are shown in solid lines to indicate positions after wedging of frangible capsule 600.

Figure 12C:
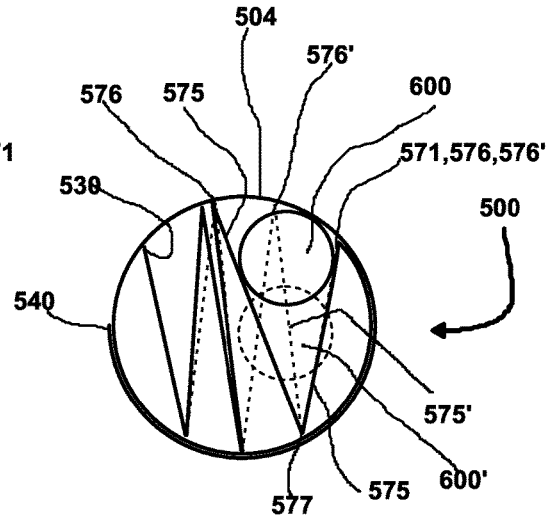
FIG. 12*c* is an alternative section view taken along the lines 12-12 of FIG. 11 but now showing the frangible capsule wedged between a different selected two of the transversely oriented panels and the frustoconical perimeter compared to that shown in FIG. 12*b* and again schematically showing the positions of both the frangible capsule and the plurality of transversely oriented panels before and after wedging of the frangible capsule.

FIG. 12*c* is an alternative section view taken along the lines 12-12 of FIG. 11 but now showing the frangible capsule 600 wedged between a different selected two of the transversely oriented panels 575 and first section 504 (frustoconical perimeter) compared to that shown in FIG. 12*b* and again schematically showing the positions both before and after wedging of the frangible capsule relative to the select two transversely oriented panels 575. The select two transversely oriented panels 575' are shown in broken lines to indicate positions before wedging of frangible capsule 600'. The select two transversely oriented panels 575 are shown in solid lines to indicate positions after wedging of frangible capsule 600. In this case one of the select two transversely oriented panels is that adjacent cut/fold line 571. Because the position of cut/fold line 571 is believed to remain relatively stationary both before and after wedging vertices 576 and 576' are show at the same positions both before and after wedging.

Figure 13:
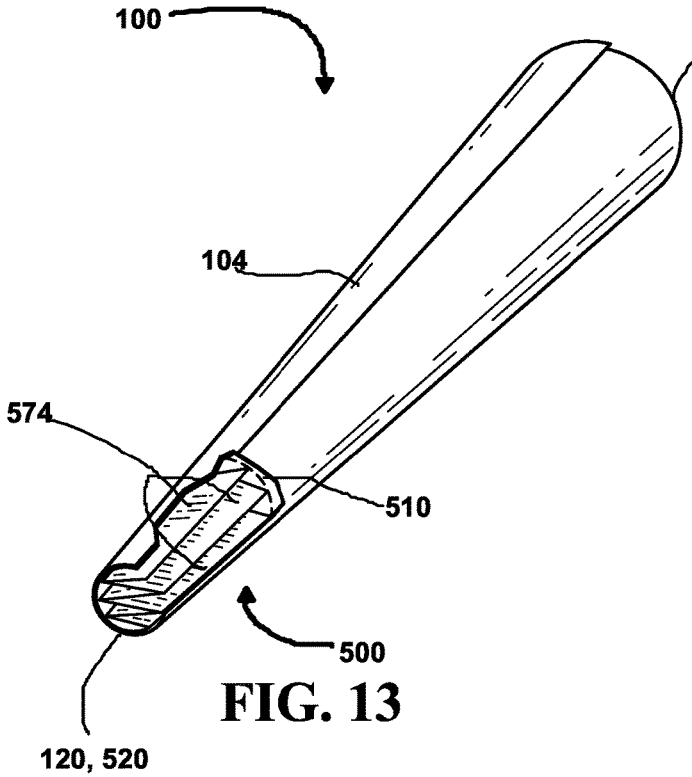
FIG. 13 is a cutout perspective view of the filter tip inside the cone of FIG. 8 before insertion of a frangible capsule into the interior of the cone.

FIG. 13 is a cutout perspective view of the filter tip inside the conical smoking shell 100 of FIG. 8 before insertion of a frangible capsule 600 into the interior 114 of the conical smoking shell 100.

Figure 13A:
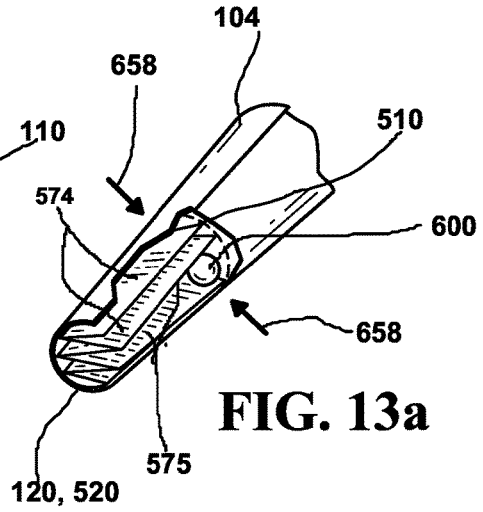
FIG. 13*a* is a cutout perspective view of the filter tip inside the cone of FIG. 11 showing the frangible capsule wedged between a selected two of the transversely oriented panels such that the frangible capsule is flush with the top of the selected two of the transversely oriented panels.

FIG. 13*a* is a cutout perspective view of the filter tip 500 inside conical smoking shell 100 and showing the frangible capsule 600 wedged between a selected two of the transversely oriented panels 575 such that the frangible capsule 600 is flush with the top (first end 510) of the selected two of the transversely oriented panels 575 of filter tip 500.

Figure 13B:
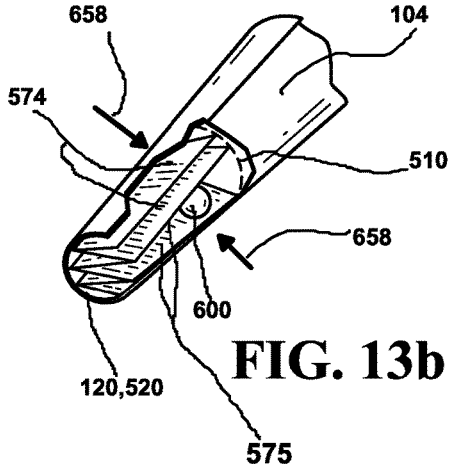
FIG. 13*b* is a cutout perspective view of the filter tip inside the cone of FIG. 11*b* showing the frangible capsule wedged between a selected two of the transversely oriented panels such that the frangible capsule is between the top and bottom of the transversely oriented panels and about 25 percent from the top.

FIG. 13*b* is a cutout perspective view of the filter tip 500 inside conical smoking shell 100 showing the frangible capsule 600 wedged between a selected two of the transversely oriented panels 575 such that the frangible capsule 600 is between the top (first end 510) and bottom (second end 510) of the transversely oriented panels 575 and about 25 percent from the top.

Figure 14:
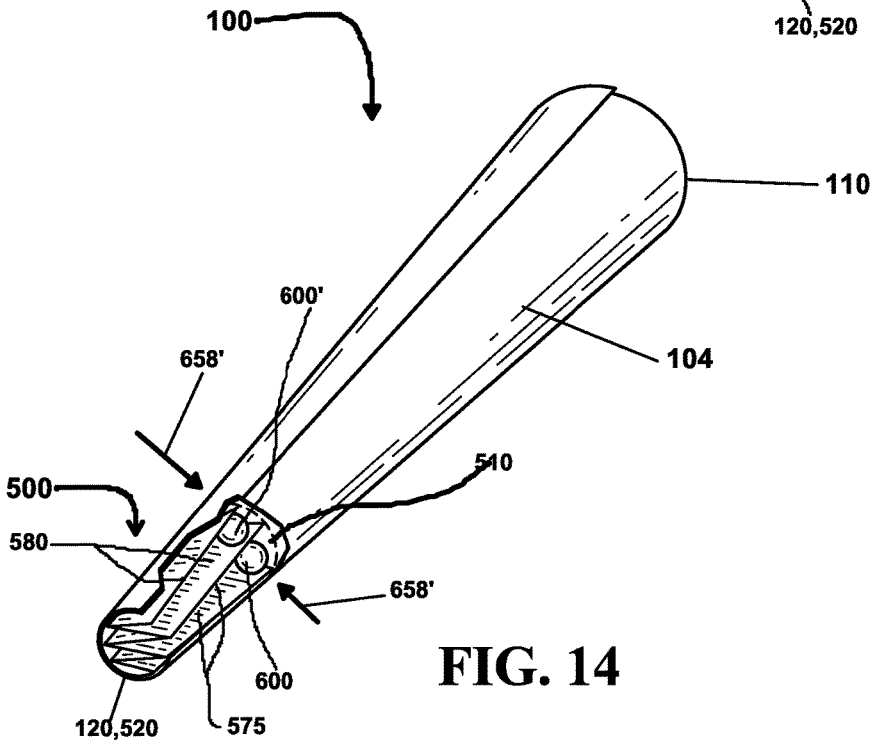
FIG. 14 is a cutout perspective view of the filter tip inside the cone of FIG. 11 showing the frangible capsule wedged between a selected two of the transversely oriented panels such that the frangible capsule is flush with the top of the selected two of the transversely oriented panels, and also showing a second frangible capsule wedged between a different a selected two of the transversely oriented panels such that the frangible capsule is flush with the top of the different selected two of the transversely oriented panels.

FIG. 14 is a cutout perspective view of the filter tip 500 inside cone 100 showing a first frangible capsule 600 wedged between a selected two of the transversely oriented panels 575 such that the frangible capsule 600 is flush with the top (first end 510) of the selected two of the transversely oriented panels 575, and also showing a second frangible capsule 600' wedged between a different selected two of the transversely oriented panels 580 such that the frangible capsule 600' is flush with the top (first end 510) of the different selected two of the transversely oriented panels 580.

Figure 15:
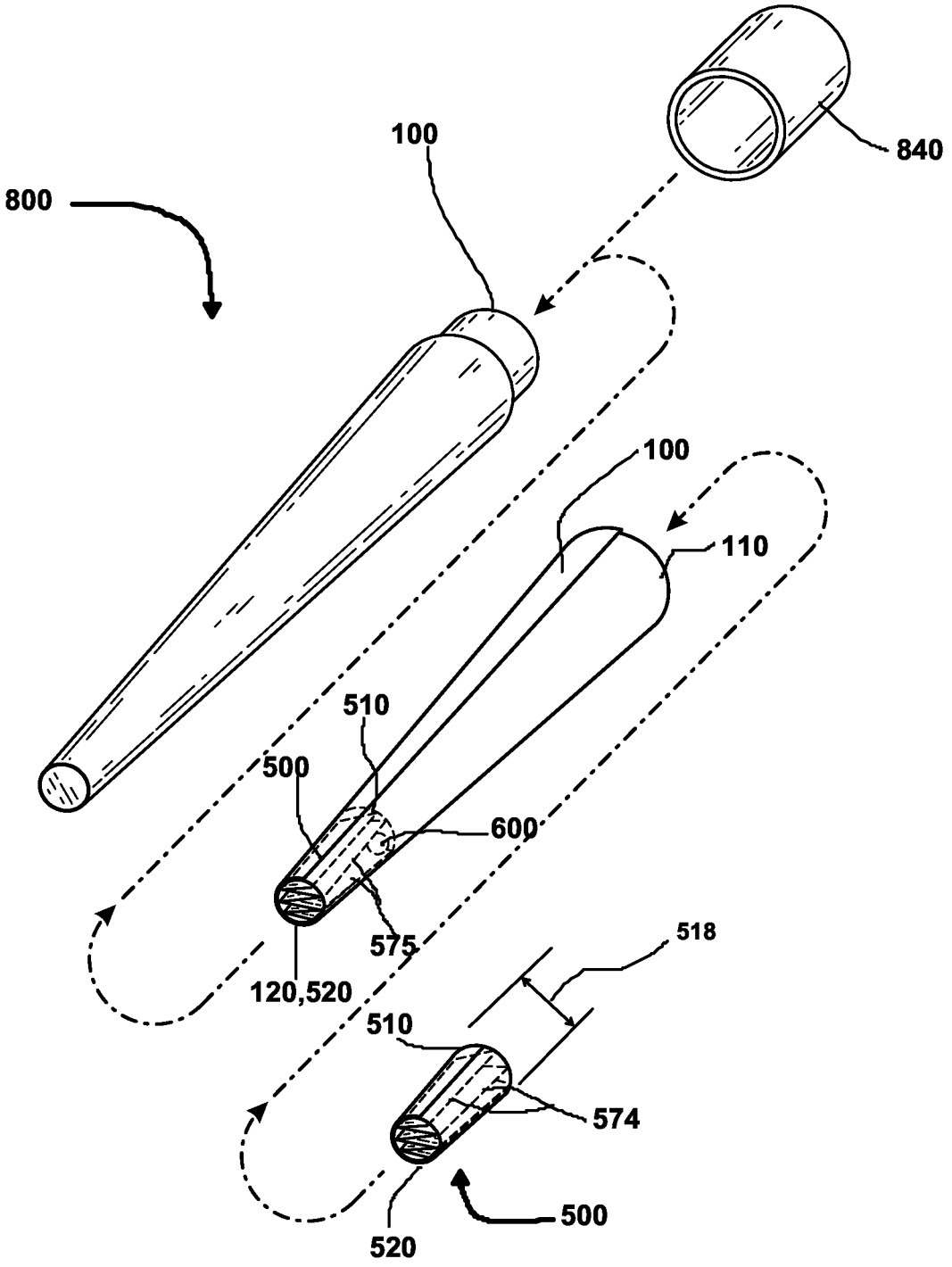
FIG. 15 is a perspective view of the conical smoking shell of FIG. 11 with frangible capsule being held by tip, and the cone being inserted into packaging. Also schematically shown is filter tip (without frangible capsule) being inserted into the cone as frangible capsule is inserted after cone with filter tip is formed (also alternatively shell can be rolled around filter tip to form cone).

FIG. 15 is a perspective view of the conical smoking shell 100 with frangible capsule 600 being held by tip 500, and the cone 100 being inserted into packaging 800. Also schematically shown is filter tip 500 (without frangible capsule 600) being inserted into the cone 100 (because frangible capsule 600 is preferably inserted after conical smoking shell 100 with filter tip 500 is formed (also alternatively cone shell 104 can be rolled around filter tip 500 to form cone 100 with filter tip 500). Packaging 800 can include closure device 840 which can be a cap.

Figure 16:
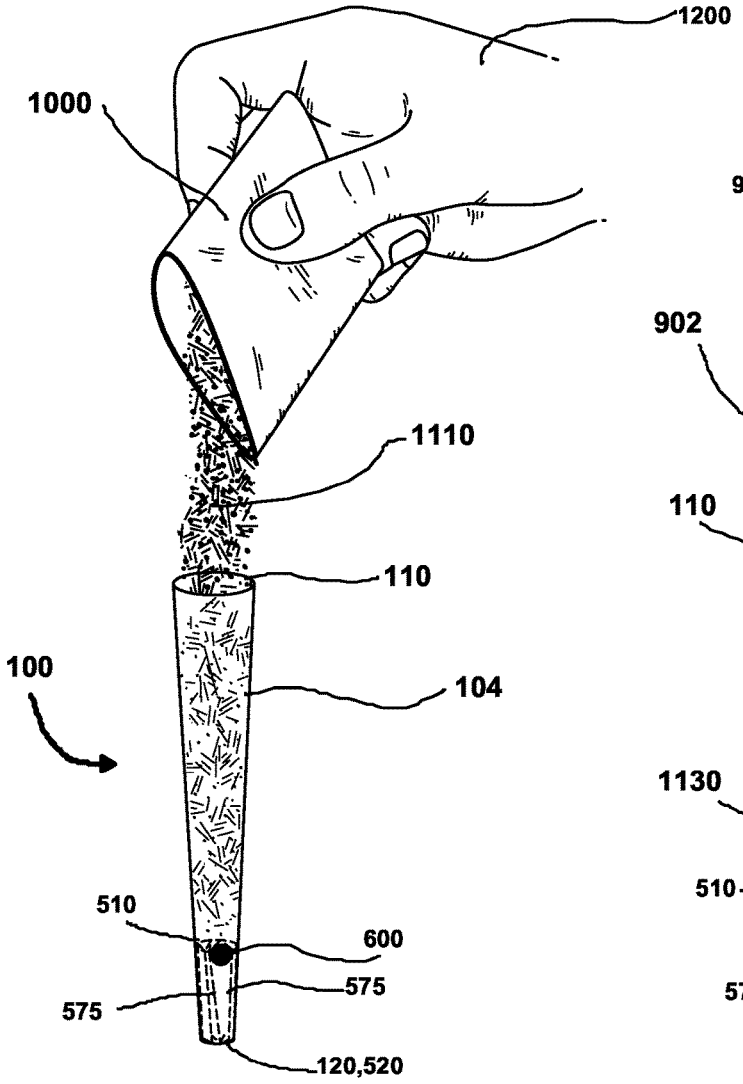
FIG. 16 is a perspective view of the conical smoking shell with filter tip being filled with smokable filler.
Figure 17:
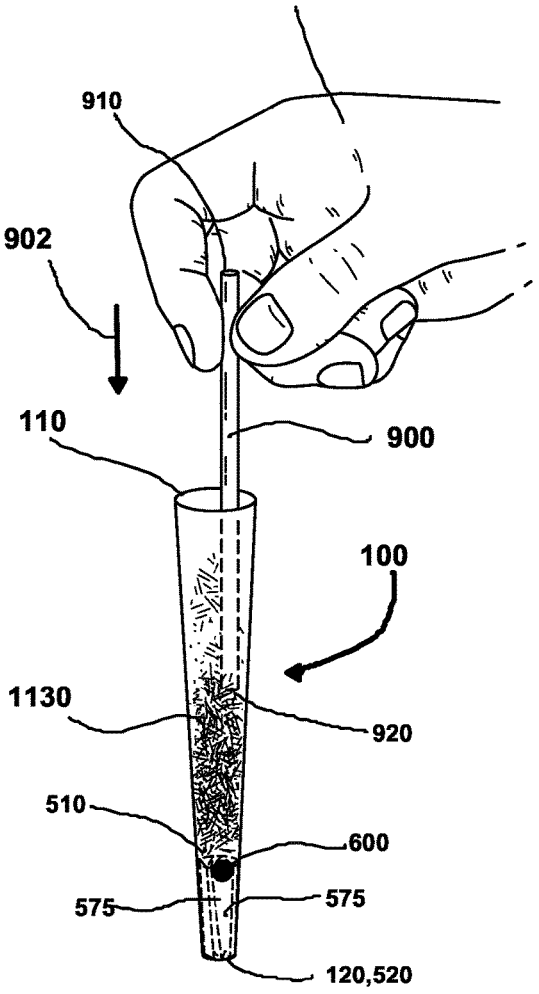
FIG. 17 is a perspective view of a rod being used as a tamping device to stuff or tamp down the smokable filler added to the conical smoking shell shown in FIG. 16.

FIG. 16 is a perspective view of conical smoking shell 100 with filter tip 500 being filled with smokable filler 1110. A user or smoker 1200 would removed the conical smoking shell 100 with filter tip 500 from the packaging 800 (not shown for clarity) and fill the interior 114 of cone 100 with smokable filler. FIG. 17 is a perspective view of a rod 900 being used as a tamping device to stuff or tamp down the smokable filler 1130 added to the conical smoking shell 100. Arrow 902 schematically indicates the repetitive tamping of the smokable filler 1130 to pack/compress it within the interior 114 of conical smoking shell 100. The filter tip 500 with plurality of transversely oriented panels 574 will prevent the smokable filler 1130 from falling out of second end 120 of conical smoking shell 100. The spacing between plurality of transversely oriented panels 574 allow air flow thru filter tip 500 during smoking. Filter tip 500 also holds frangible capsule 600 which is wedged in filter tip 500.

Figure 18:
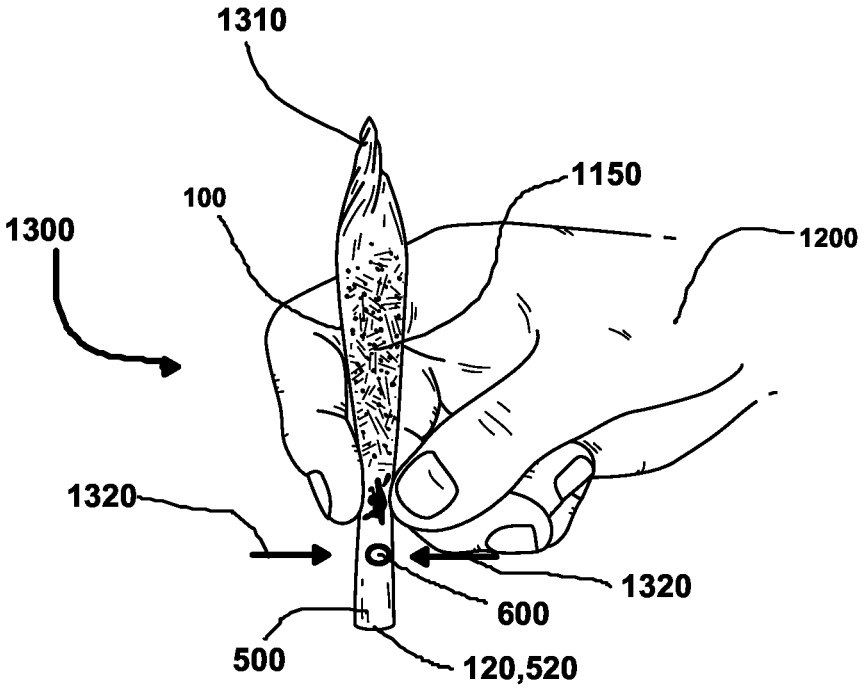
FIG. 18 is a perspective view of the conical smoking shell filled with smokable filler, having the first end of the cone twisted or folded and forming a finished smoking product, and further schematically indicating that the outside of filter tip over the area of the held frangible capsule can be squeezed to fracture/break/open frangible capsule and causing the contents of frangible capsule to enter the interior of the filter tip.

FIG. 18 is a perspective view of conical smoking shell 100 now filled with smokable filler 1150, having the first end 110 of the conical smoking shell 100 closed (e.g. twisted or folded) 1310 forming a finished smoking product 1300, and further schematically indicating that the outside of filter tip 500 over the area of frangible capsule 600 being held by wedging in filter tip 500 can be squeezed to fracture/break/open frangible capsule 600 and causing the contents of frangible capsule 600 to enter the interior of the filter tip 500. Arrows 1320 schematically indicate force being applied to filter tip 500 to break or rupture frangible capsule 600 which releases its contents into the interior of filter tip 500.

Figure 19:
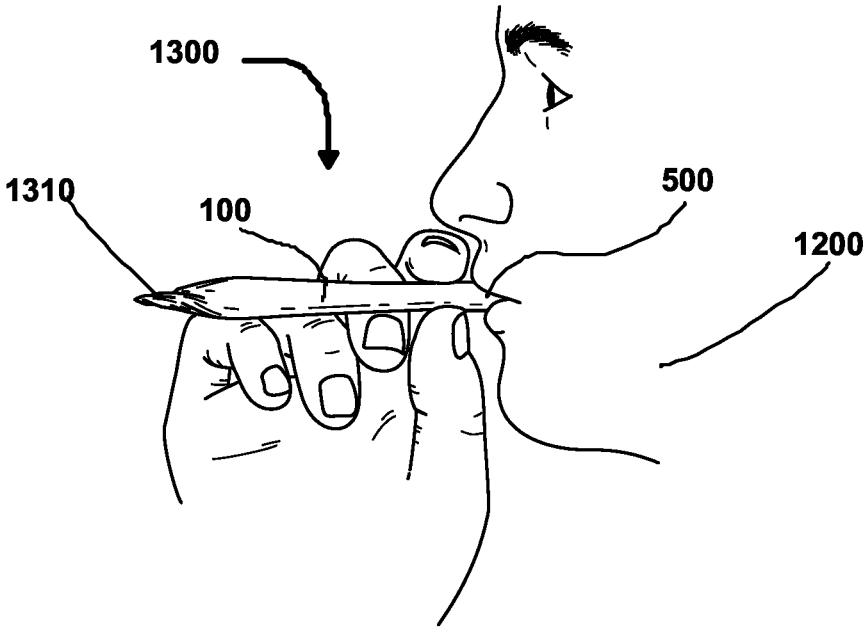
FIG. 19 schematically shows a user smoking the finished smoking product of FIG. 18.

FIG. 19 schematically shows a user 1200 smoking the finished smoking product 1300.

Figure 20:
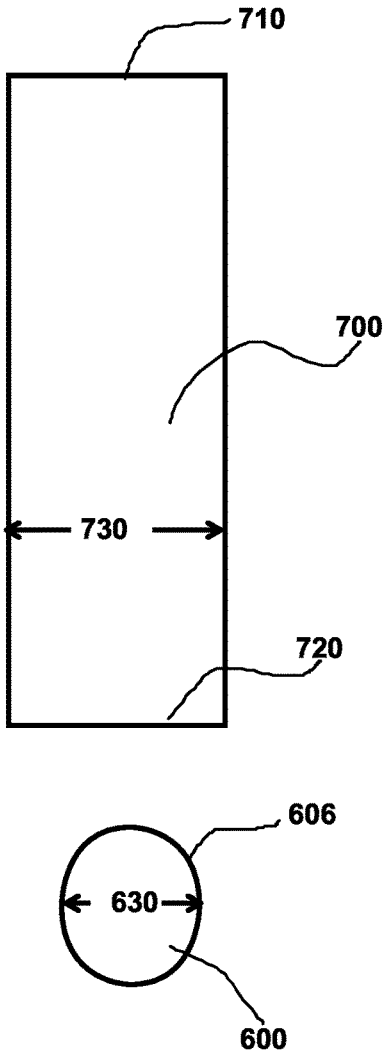
FIG. 20 shows one embodiment of an insertion tool with a flat second end.

FIG. 20 shows one embodiment of an insertion tool 700 with a flat second end 720. Preferably, dimension 730 of insertion tool 700 is larger than dimension 630 of frangible capsule. Such larger dimension 730 will make is easier to wedge frangible capsule 600 between a select two transversely oriented panels 755 without frangible capsule slipping away from insertion tool 700 during the wedging process. Also preferably dimension 730 of insertion tool 700 can be slightly smaller than dimension 518 of filter tip 500. This size for dimension 730 should minimize the tendency of capsule 600 slipping away from insertion tool 700 during the wedging process as sidewall 104 of cone will restrict movement of frangible capsule 600 and there would not be enough room for capsule 600 to slip out from under insertion tool 700 during the wedging process.

Figure 21:
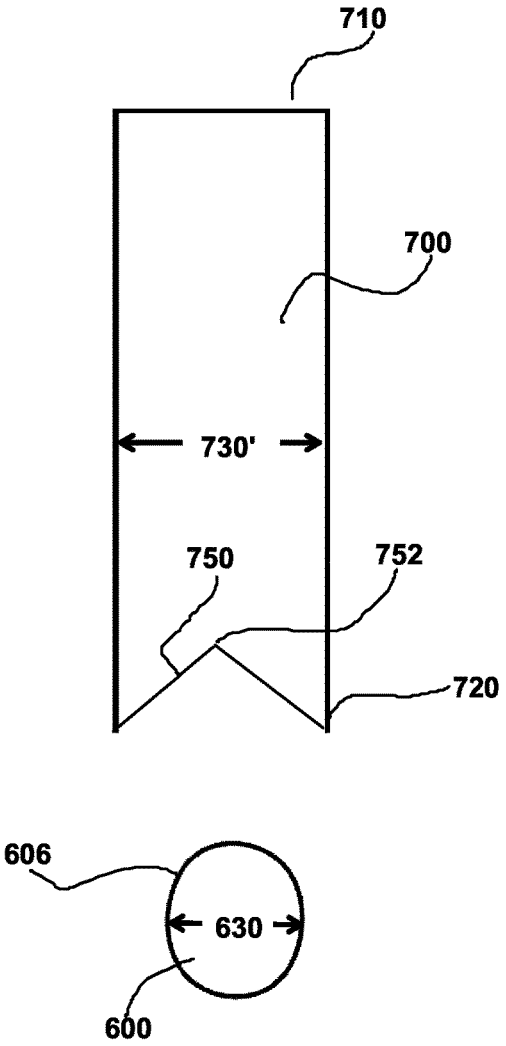
FIG. 21 shows another embodiment of an insertion tool with a shaped second end.

FIG. 21 shows another embodiment of an insertion tool 700 with a shaped second end 720 having a shaped area 750 that resists slippage between second end 720 and frangible capsule 600 during the wedging process. Preferable shaped area 750 is a concave shape such as a v-shape 752. In various embodiments shaped area 750 can have a radius of curvature that corresponds to the radius of curvature of frangible capsule 600 (when frangible capsule 600 has a radius of curvature such as when it is spherical).

Figure 22:
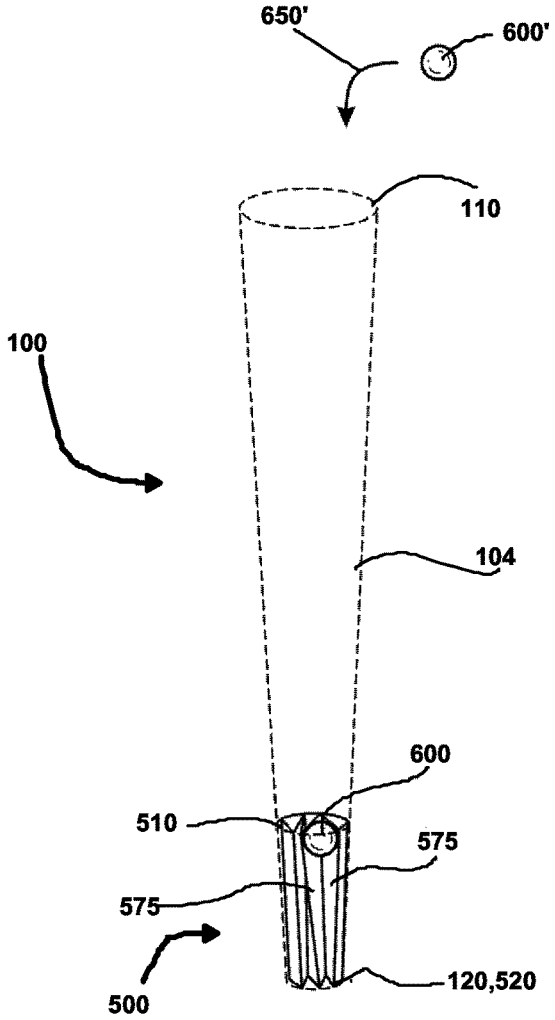
FIG. 22 shows another embodiment where a second frangible capsule will be wedged into filter tip in combination with a first frangible capsule.
Figure 23:
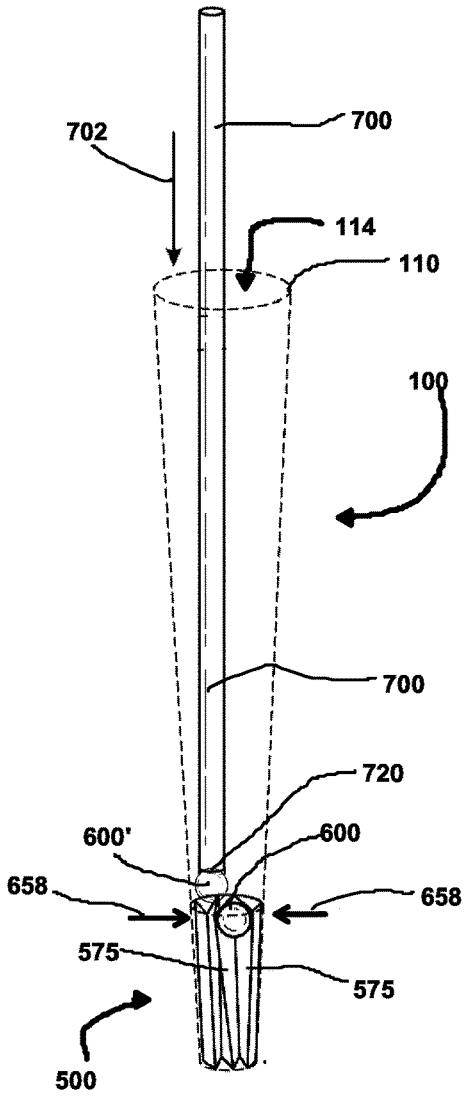
FIG. 23 shows the second frangible capsule being wedged into filter tip after the first frangible capsule.
Figure 24:
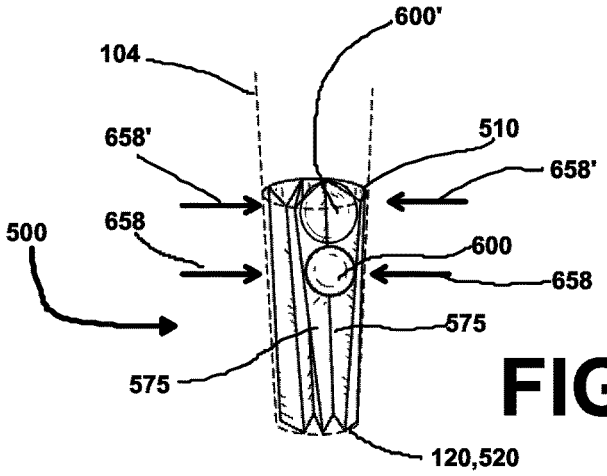
FIG. 24 shows an alternative embodiment where first and second frangible capsules are supported by the same select two of the plurality of transversely oriented panels.

FIG. 22 shows another embodiment where a second frangible capsule 600' being placed in the interior 114 of smokable cone 100 so that it can be wedged into filter tip 500 in addition to and/or in combination with a first frangible capsule 600. Arrow 650' schematically indicates the insertion of second frangible capsule 600'. First frangible capsule 600 is shows as already being held between the selected two 575 of the plurality of transversely oriented panels. FIG. 23 shows the second frangible capsule 600' being wedged into filter tip 500 after the first frangible capsule 600 was previously wedged. The procedure for wedging is substantially similar to that used for first frangible capsule 600. Second end 720 of insertion tool 700 can be used to push downwardly on second frangible capsule 600' (schematically indicated by arrow 702) such that second frangible capsule 600' will go between and spread apart a select two of the plurality of transversely oriented panels 754. The actual selected two transversely oriented panels are by choice of the installer and can be the same select two 575 transversely oriented panels as for the first frangible capsule 600 (see FIG. 24), or a different select two 580 transversely oriented panels compared to the first frangible capsule (see FIG. 14). FIG. 24 shows an alternative embodiment where first 600 and second 600' frangible capsules are supported by the same select two 575 of the plurality of transversely oriented panels. Arrows 658 schematically indicate the wedging/holding force on first frangible capsule 600, and arrows 658' schematically indicate the wedging/holding force on second frangible capsule 600. Regarding first frangible capsule 600 it will also be held in by contact with second frangible capsule 600'. Where first 600 and second 600' frangible capsules are wedged within the same select two transversely oriented panels 575, second frangible capsule 600' can be of a larger size than first frangible capsule to compensate for a loss of wedging force by first frangible capsule 600 being wedged lower in the same select two transversely oriented panels 575 than second frangible capsule 600' which is believed will tend to reduce the wedging force 658' seen by second frangible capsule 600' if it were the same size as first frangible capsule 600. In various embodiments the ratio of the size (e.g., volume, surface area, diameter, etc.) of second frangible capsule 600' can be larger than that of the size of first frangible capsule by at least 5, 10, 20, 30, 40, 50, 60, 70, 80, 90, and 100. In various embodiments the increase in size can fall within a range of between any two of the above reference size increase percentages.

The following is a Table of Reference Numerals used in this patent application:

TABLE OF REFERENCE NUMERALS

Reference Number Description

10 smoking article
100 hollow cone
102 sidewall
110 first end
114 interior
120 second end
130 inner surface
140 outer surface
150 first opening
160 second opening
180 filter
400 sheet of material
402 first side
402 second side
410 first end
420 second end
430 first edge
440 second edge
460 tab or lip
490 arrow
492 arrow
500 sheet of material
502 support section
503
504 first section
506 second section
508 sheet
510 first end
511 upper perimeter
512 first angle
514 second angle
518 dimension
520 second end
521 lower perimeter
530 first side
540 second side
560 tab or lip
570 plurality of perforation lines, lines, or etched areas
571 first perforation line or etched area
574 plurality of transverse panels
575 select two of transversely oriented panels
576 tips of select two transversely oriented panels
577 vertex
580 select two of transversely oriented panels
590 arrow
597 arrow
598 arrow
600 frangible capsule
604 interior
606 shell
610 filling (e.g., liquid)
630 dimension
654 arrows
658 arrows
700 insertion device
702 arrow
710 first end
720 second end
730 dimension
750 shaped area
752 concave area (e.g., v-shaped)
754 radius of curvature
772 closed end (e.g., twisted knot or pigtail)
800 package/wrapper
802 arrow
810 closed end
820 open end
830 interior
840 seal
900 tamper
902 arrow
910 first end
920 second end
1000 pouch/container
1100 smokable material
1110 portion of smokable material being poured
1130 portion of smokable material pushed by stuffer or tamper
1150 filled smokable material
1200 smoker

1300 finished smoking article
1310 closed tip (twisted)
1320 arrows

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A packaged smoking apparatus that generates a smokable article, comprising:

a) a package having a package interior and an end portion with a sealed opening;

b) a smokable cone being hollow with a cone interior and cone sidewall;

c) a reinforcing tip having a tip interior, the reinforcing tip occupying a position within the cone interior, the reinforcing tip having a stiffness that is greater than the stiffness of the cone sidewall;

d) wherein, the reinforcing tip has a plurality of transversely oriented panels forming a plurality of pathways through the tip interior;

e) a first frangible capsule positioned between a first selected two of the plurality of transversely oriented panels, the frangible capsule having a first outer shell and a first capsule interior;

f) wherein the first frangible capsule is held in place by a wedging force generated by wedging apart the first selected two transversely oriented panels by direct contact between the first outer shell of the first frangible capsule and the first selected two transversely oriented panels; and g) wherein the smokable cone is packaged for sale inside the package interior as an assembly.

2. The packaged smoking apparatus of claim 1, wherein the reinforcing tip includes a frustoconical perimeter, and the wedging force is generated by the wedging apart the first selected two transversely oriented panels and the frustoconical perimeter by direct contact between the first outer shell of the first frangible capsule with both: (i) the first selected two transversely oriented panels and (ii) the frustoconical perimeter.

3. The packaged smoking apparatus of claim 1, wherein the reinforcing tip includes a second frangible capsule having a second outer shell held in place by direct contact between the second outer shell and a second selected two of the plurality of transversely oriented panels.

4. The packaged smoking apparatus of claim 3, wherein the second selected two of the plurality of transversely oriented panels are different from the first selected two of the plurality of transversely oriented panels.

5. The packaged smoking apparatus of claim 3, wherein the first and second frangible capsules are spherical in shape, and the second frangible capsule has a second diameter that is at least fifty percent larger than a diameter of the first frangible capsule.

6. The packaged smoking apparatus of claim 1, wherein the reinforcing tip includes at least 4 transversely oriented panels which are connected to each other in series at a plurality of spaced apart vertices which are each v-shaped.

7. The packaged smoking apparatus of claim 1, wherein the reinforcing tip includes at least 5 transversely oriented panels which are connected to each other in series at a plurality of spaced apart vertices.

8. The packaged smoking apparatus of claim 1, wherein the reinforcing tip includes at least 6 transversely oriented panels which are connected to each other in series at a plurality of spaced apart vertices.

9. The packaged smoking apparatus of claim 1, wherein the selected two transversely oriented panels have a surface that have been roughened by a mechanical means.

10. The packaged smoking apparatus of claim 9, wherein the selected two transversely oriented panels have a surface that have been roughened by mechanical sanding using a sandpaper selected from the group consisting of 40, 80, 100, 120, and 220 grit.

11. The packaged smoking apparatus of claim 9, wherein the selected two transversely oriented panels have a surface that have been roughened by mechanical means to increase their surface roughness by at least 50 percent.

12. The packaged smoking apparatus of claim 1, wherein the outer shell of the frangible capsule has a surface that has been roughened by a mechanical means.

13. The packaged smoking apparatus of claim 12, wherein the outer shell of the frangible capsule has a surface that has been roughened by mechanical sanding using a sandpaper selected from the group consisting of 40, 80, 100, 120, and 220 grit.

14. The packaged smoking apparatus of claim 12, wherein the outer shell of the frangible capsule has a surface that has been roughened by mechanical means to increase its surface roughness by at least 50 percent.

15. The packaged smoking apparatus of claim 1, wherein the outer shell of the frangible capsule and the selected two transversely oriented panels include an adhesive.

* * * * *